United States Patent [19]

Hart, Jr.

[11] 4,053,101

[45] Oct. 11, 1977

[54] COMBINATION SHIPPING CONTAINER AND DISPLAY BOX

[75] Inventor: John J. Hart, Jr., Geneva, N.Y.

[73] Assignee: International Paper Company, New York, N.Y.

[21] Appl. No.: 729,637

[22] Filed: Oct. 5, 1976

[51] Int. Cl.[2] ..... B65D 5/22; B65D 5/46

[52] U.S. Cl. ..... 229/36; 229/44 R; 229/34 R

[58] Field of Search ..... 229/15, 33, 34, 36, 229/44 R

[56] References Cited

U.S. PATENT DOCUMENTS

| | | | |
|---|---|---|---|
| 2,013,646 | 9/1935 | Andrews | 229/34 R X |
| 2,248,547 | 7/1941 | Osteen | 229/36 X |
| 2,960,149 | 11/1960 | Throssel | 229/34 R X |
| 3,692,174 | 9/1972 | Ross | 229/34 R X |
| 3,737,094 | 6/1973 | Beaver et al. | 229/34 R |
| 3,758,018 | 9/1973 | Black | 229/15 |
| 3,826,420 | 7/1974 | Bamburg et al. | 229/36 X |

*Primary Examiner*—Davis T. Moorhead
*Attorney, Agent, or Firm*—Walt Thomas Zielinski

[57] ABSTRACT

A combination shipping container and compartmented display box capable of being formed from a single-piece paperboard as corrugated board blank is disclosed. The blank is suitable for erection into a rigid, multi-layered container having a plurality of compartments formed by interlocking divider walls and a top or cover portion which is separable from the bottom portion defining the open top, compartmented display box. Means are provided for separating the divider walls which form the compartments from the blank and, for separating the top or cover portion of the container from the display box.

7 Claims, 8 Drawing Figures

COMBINATION SHIPPING CONTAINER AND DISPLAY BOX

BACKGROUND OF THE INVENTION

This invention relates generally to a new and useful container. More particularly, it relates to a combination shipping container and compartmented display box formed from a single-piece blank of foldable paperboard or corrugated board. The various components making up the entire container are included in, and, some are separable from, the blank. That is to say, the divider walls which, along with the side, front, and back walls, define the compartments of the display box can be detached from the blank as initially formed. Also, the fold line by which the outer body portion defining the cover section or top of the container is hingedly connected to the bottom portion defining the display box is provided with a continuous line of perforations that permit separation or removal of the top portion. The resultant containers are so constructed that several of them can be stacked, one on the other, without damage to their contents.

In transporting packaged consumer goods to market, it is usually necessary that the containers utilized be of rugged construction. Such containers of goods should be capable of being transported from the manufacturer to the distributer or retailer without damage. Again, if empty containers had to be assembled prior to shipment to the manufacturer who would then fill them with the packaged goods, there would, of course, be resultant dead space which would force either reduction of the size of the shipment per unit of shipping space or an increase thereof at greater cost per order of containers. This problem is usually resolved by shipping the blanks, from which the containers are to be made, flat and stacked one on another. Again, such containers should, preferably, be made from one-piece blanks, since containers made from more than one blank obviously require additional labor in assembling and handling and, therefore, added expense. Accordingly, it is an object of this invention to provide a rugged combination shipping container and display box capable of being formed from a one-piece blank which overcomes the aforesaid shipping and handling problems.

Another object of this invention is to provide a combination shipping container and display box in which the outer portion defining the cover section of the display box is divided from it by a line of perforations extending laterally along the top edge of the back wall of the display box to permit its removal from the lower portion defining the display box.

The manufacturer of the goods to be packaged usually assembles the containers, either manually or by means of appropriate machines, into their desired erected form. Therefore, simplicity of the container blank design is a very important factor. Obviously, the task of the manufacturer of the goods to be packaged is complicated if he is required to assemble and secure the container in its desired form by use of extraneous means such as staples, straps, rivets, glue, paste, etc. This problem is resolved by incorporating in the blank means to secure the container in its desired erected form. Accordingly, it is another object of this invention to provide a container blank of relatively simple design which requires a minimum of manual skill or apparatus, and no extra parts, to be transformed into the desired erected form.

Once assembled and filled with the goods to be packaged whether they are in smaller boxes, packets, cans, bottles, jars, bags or the like, the shipping containers are often stacked one on the other. For this reason, such containers must first be of durable construction to withstand the weight of other similarly filled containers which are stacked on them. Second, unless such containers are sturdy enough to endure not only the weight of numbers of like containers stacked thereon, but the duration of the stacking required and adverse handling and shipping circumstances, there is a problem of having the contents thereof damaged. Therefore, still another object of this invention is to provide a container wherein the wall thicknesses are doubled or tripled simply by overlapping elements of the blank when the container is erected.

With these and other objects in view, the nature of which will be more apparent, the invention will be more fully understood by references to the attached drawings, the accompanying detailed description, and the appended claims.

Figure 1:
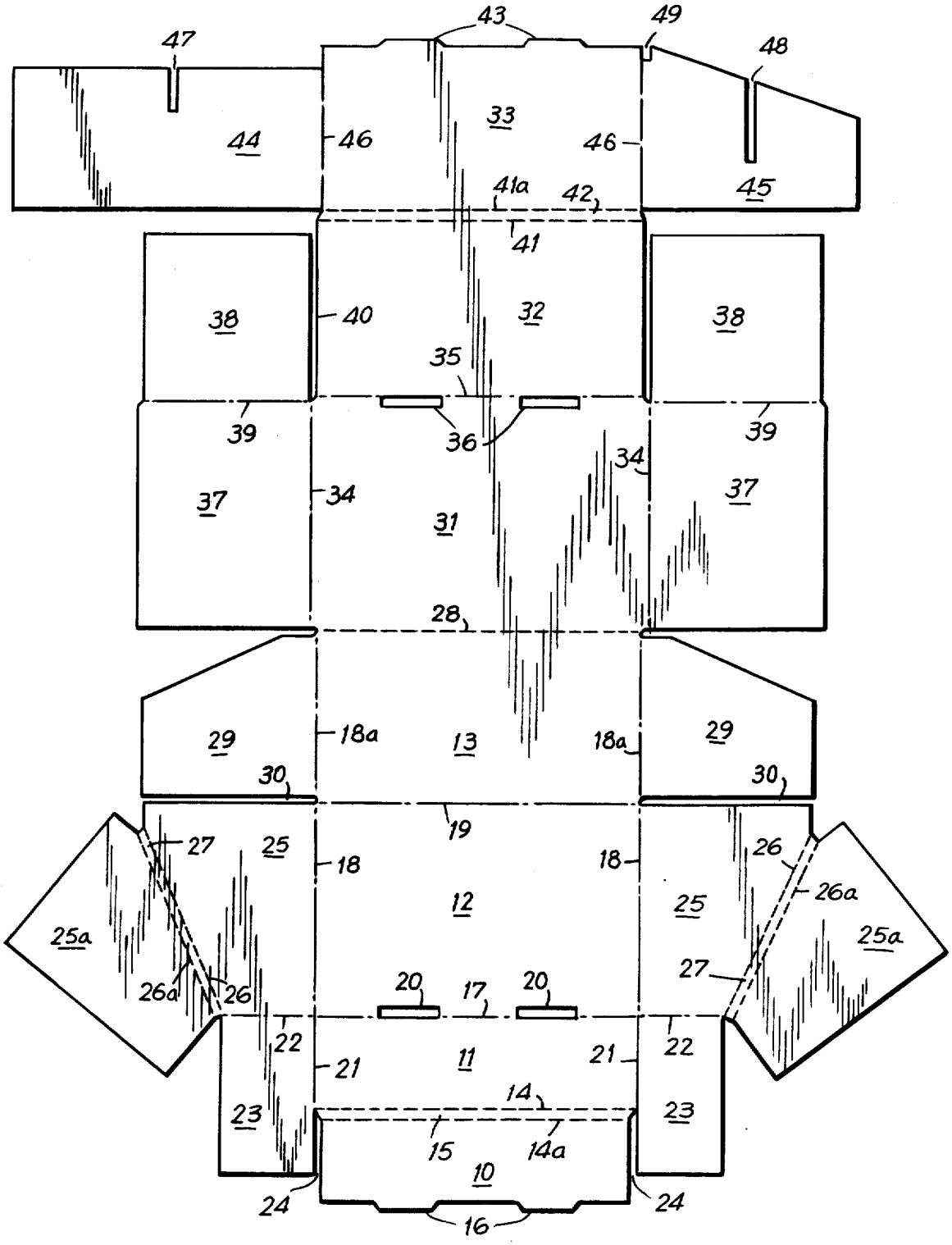
FIG. 1 is a plan view of the integrated blank from which the combination shipping container and compartmented display box made in accordance with this invention is formed.

Referring to the drawings in detail, the invention, as illustrated, is embodied in a combination shipping container and display box fabricated from corrugated board and includes a bottom portion defining a display box provided with interlocking divider walls normal to one another and a top portion defining a cover section, formed from a single, generally rectangular blank 1 shown in FIG. 1.

Blank 1 is provided with a first series of substantially rectangular members which include the inner front wall panel 10, the outer front wall panel 11, the bottom panel 12, and the outer rear wall panel 13 of the display box, respectively.

Said inner front wall panel 10 is hingedly connected to said outer front wall panel 11 by means of a first pair of narrowly spaced apart lateral parallel fold lines 14 and 14a which define a front wall top ledge panel 15 disposed therebetween and is also provided with a pair of tabs 16 spaced apart along its lateral outer edge.

Also, in this portion of the blank which is to be made up as the display box, there are a pair of longitudinal slits 21 and a lateral fold line 22 beginning at the end of and extending in a direction perpendicular to said slits 21 to define the intermediate front walls panels 23. The width of said outer front wall panel 11 and that of said lateral parallel fold line 14 slightly exceed that of said inner front wall panel 10 and said lateral parallel fold line 14a, preferably by the width of a pair of longitudinal slots 24.

Said bottom portion 12 is defined by and hingedly connected to outer front wall panel 11 along lateral fold line 17, a pair of longitudinal fold lines 18, and a second lateral fold line 19 and is provided with a pair of lateral slots 20 disposed along said lateral fold line 17 and spaced apart from one another so as to correspond with said inner front wall panel tabs 16. Lateral fold line 17 is coextensive with fold lines 22 and is preferably perpendicular to longitudinal fold lines 18.

In the portion of the blank from which the display box is formed there are included a pair of substantially pentagonal outer side wall panels 25 hingedly connected to said bottom panel 12 by means of said first pair of longitudinal fold lines 18, and a pair of narrowly spaced parallel fold lines 26 and 26a hingedly connecting said outer side wall panels 25 to substantially pentagonal inner side wall panels 25a to define side wall top ledge panels 27 disposed therebetween. Each of the dimensions of said inner side wall panels 25a has dimensions slightly less than that of each of said outer side wall panels 25.

The outer rear wall panel 13 is defined by said second lateral fold line 19, a pair of longitudinal fold lines 18a which are coextensive with said first pair of longitudinal fold lines 18, and a perforated lateral fold line 28, said outer rear wall panel 13 being substantially higher than said front wall panel 11. A pair of substantially pentagonal intermediate side wall panels 29 are defined by a pair of lateral slots 30 beginning at and extending in a direction perpendicular to said longitudinal fold lines 18a which hingedly connect said intermediate side wall panels 29 to said outer rear wall panel 13. Said intermediate side wall panels 29 have the same configuration as, but have dimensions slightly smaller than, those of said inner and outer side wall panels 25 and 25a, so as to allow the latter to overlap and thereby form top ledge panel 27.

The blank is also provided with a second series of substantially rectangular members which comprise the top panel 31 of the cover section and the outer rear wall panel 32 and the inner rear wall panel 33. Said top panel 31 is defined by a pair of longitudinal fold lines 34, a fourth lateral fold line 35, and by perforated lateral fold line 28 which hingedly connects it to the outer rear wall panel 13 of the display box is formed. Top panel 31 is provided with a second pair of lateral slots 36 spaced apart along said fourth lateral fold line 35. In this cover portion of the blank, there is included a pair of opposed cover section side wall panels 37 which are hingedly attached to said cover section top panel 31 by means of longitudinal fold lines 34. Each of said cover section side wall panels 37 is provided with an intermediate rear wall panel 38 hingedly connected thereto by means of lateral fold line 39. Said intermediate rear wall panels 38 are defined by said lateral fold lines 39 and longitudinal slots 40.

Said cover section inner rear wall panel 33 is hingedly connected to said cover section outer rear wall panel 32 by means of a fourth pair of narrowly spaced apart lateral parallel fold lines 41 and 41a which define a rear wall top ledge panel 42 disposed therebetween. The width of said cover section outer rear wall panel 32 and that of said fourth lateral parallel fold line 41 slightly exceed those of said cover section inner rear wall panel 33 and said fourth lateral parallel fold line 41a to permit the overlapping of said intermediate rear wall panels 38 by said cover section inner rear wall panel 33 when the cover section is erected.

Cover section inner rear wall panel 33 is provided with a pair of tabs 43 spaced apart along its outer edge and is hingedly connected along the inner edge to said cover section outer rear wall panel 32 by means of said fourth pair of narrowly spaced apart lateral parallel fold lines 41 and 41a, so as to receive with said second pair of lateral slots 36 in the erected cover section.

Also, in this portion of the blank which is to be made up as the cover section, there are included a corresponding substantially rectangular intersecting divider wall 44 and a substantially trapezoidal intersecting divider wall 45 which are detachably connected to said cover section inner rear wall panel 33 along its side edges by means of longitudinal perforated score lines 46. Said intersecting divider wall 44 is provided with a longitudinal slot 47 which is centrally located and extends from its outer edge in a direction parallel to said longitudinal perforated score lines 46. Said intersecting divider wall 45 is also provided with a longitudinal slot 48 which is centrally located and extends from its outer edge in a direction parallel to said longitudinal score lines 46. Slot 47 of said intersecting divider wall 44 and slot 48 of said intersecting divider wall 45 are designed to be joined together, with the latter being substantially longer. Intersecting divider wall 45 is also provided with a notch 49 which is disposed along said longitudinal perforated score line 46. Notch 49 is designed to receive divider wall 44 which, if desired, can ultimately be engaged therewith to serve as a display panel in the uncovered display box as described hereinbelow.

Figure 2:
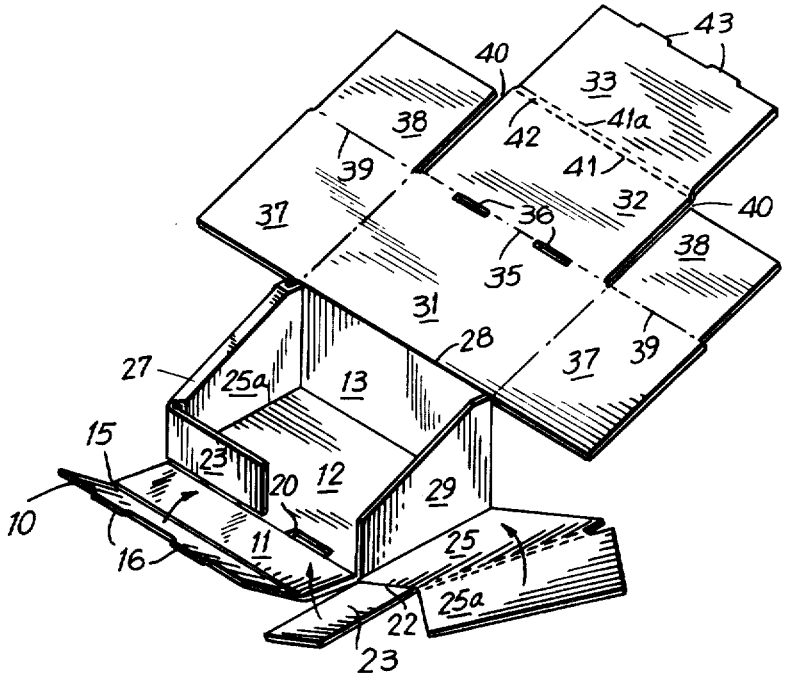
FIG. 2 is a perspective view of the combination shipping container and display box, wherein the latter is partially erected.
Figure 3:
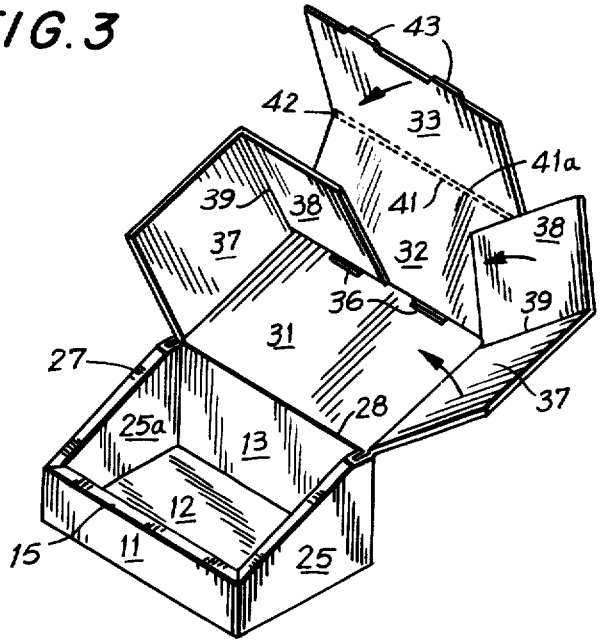
FIG. 3 is a perspective view of the combination shipping container and display box, wherein the display box is completely erected and the top section therefor is partially erected.
Figure 5:
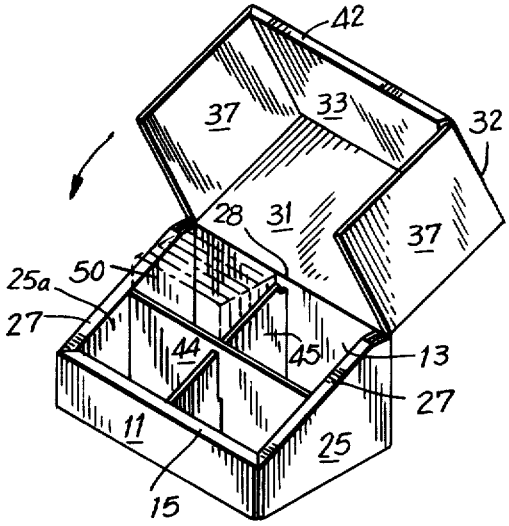
FIG. 5 is a perspective view of the fully erected combination shipping container and partially filled compartmented display box, with the top portion opened.
Figure 6:
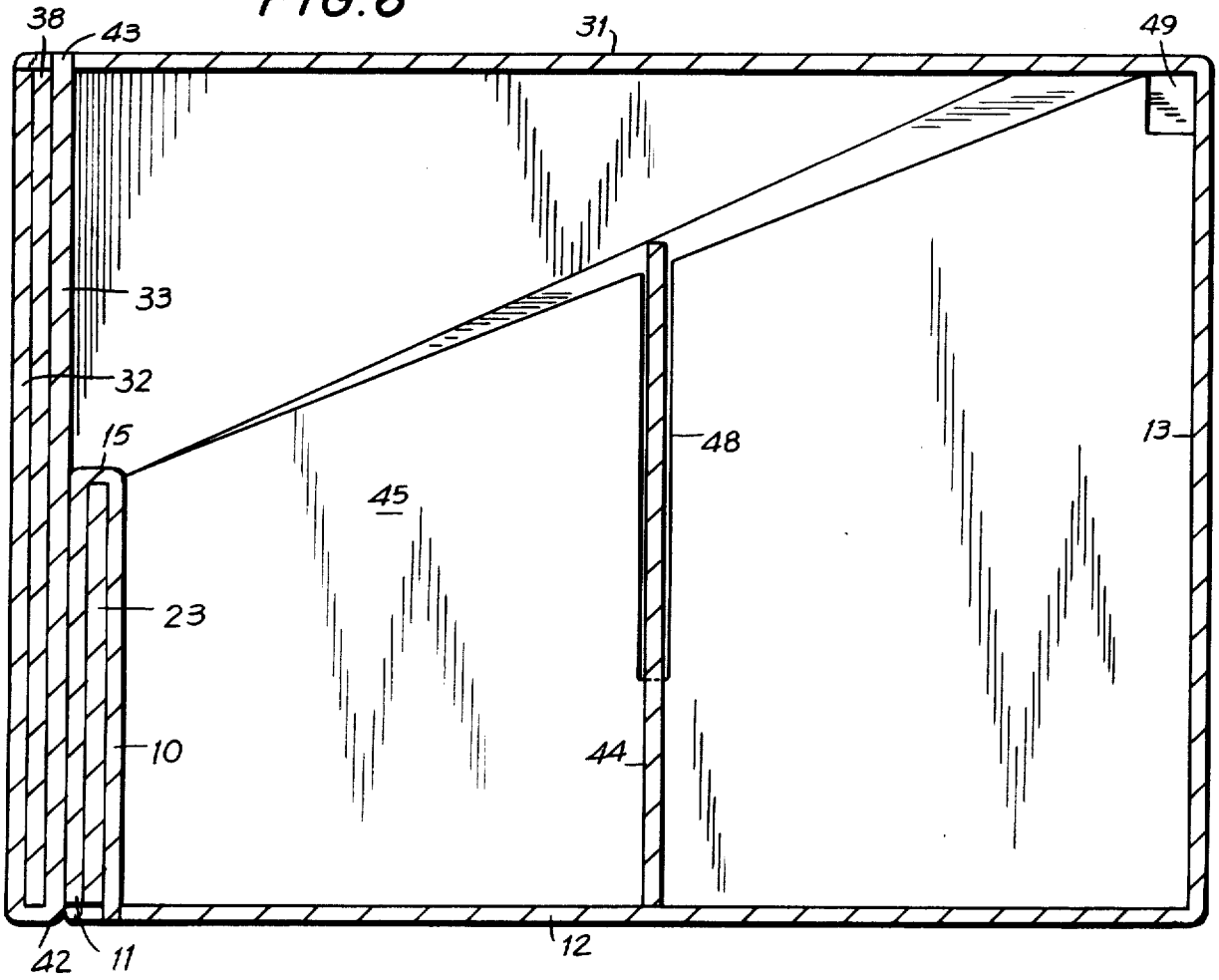
FIG. 6 is a cross-sectional side view of the erected, closed combination shipping container and compartmented display box of FIG. 4, taken along line 6—6.
Figure 8:
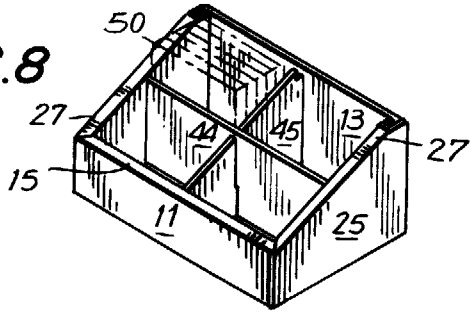
FIG. 8 is a perspective view of the erected combination shipping container and compartmented display box after the cover portion has been removed therefrom.
Figure 7:
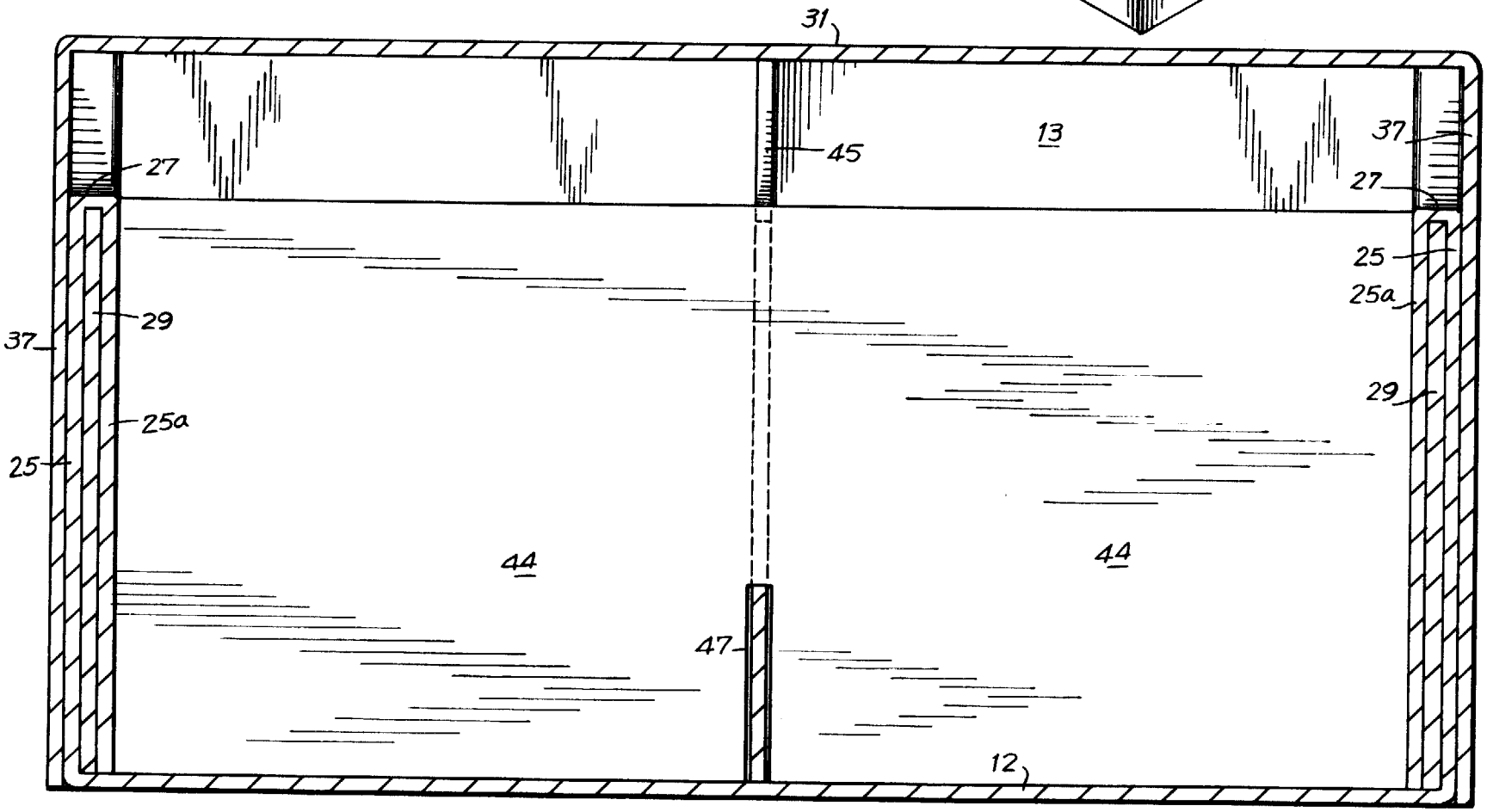
FIG. 7 is a cross-sectional view of the erected combination shipping container and compartmented display box of FIG. 4, taken along line 7—7.

In accordance with this invention, the erected combination shipping container and display box is formed from the blank shown in FIG. 1 in the following manner; the bottom portion comprising the display box is formed as shown in FIG. 2, by folding the outer side wall panels 25 and 25a along the first pair of longitudinal fold lines 18, towards the center of bottom panel 12, folding the intermediate front wall panels 29 forward along the second pair of longitudinal fold lines 18a, folding outer front wall panels 11 upwardly along first lateral fold line 17, folding inner front wall panel 10 in a forward and downward direction along first pair of narrowly spaced parallel fold lines 15 and 15a so that inner front wall panel 10 and the thusly formed front wall top ledge panel 15 is perpendicular thereto overlaps intermediate front wall panels 23, with inner front wall tabs 16 inserted into bottom panel slots 20 as seen in FIG. 6. Next, intersecting divider walls 44 and 45 are detached from the cover section inner rear wall panel 33 by severing longitudinal perforated score lines 46, as respectively shown in FIG. 1, and set aside. The cover section is formed by first folding side wall panels 37 inwardly along the third pair of longitudinal fold lines 34, folding said cover section intermediate rear wall panels 38 forward along the second pair of lateral fold lines 39 folding cover section outer rear wall panel 32 forward along fourth lateral fold line 35, and then folding cover section inner rear wall panel 33 forward along the fourth pair of narrowly spaced apart lateral fold lines 41 and 41a as seen in FIG. 3, so that the cover section inner rear wall panel 33 and the thusly formed rear wall top ledge panel 42 overlap cover section intermediate rear wall panels 38, with tabs 43 inserted into the second pair of lateral slots 36. Then, as shown cross-sectionally in FIGS. 6 and 7, the compartments within the display box are formed by engaging slots 47 and 48 of intersecting divider walls 44 and 45, respectively. The thusly formed divider wall construction is thereafter placed into the display box in such a manner that the inclined edge of divider wall 45 is in the same plane as the side wall top ledge panels 27, with the two side edges of divider wall 44 abutting the respective inner side wall panels 25 and 25a, as shown in FIGS. 5 and 8. After the combination shipping container and compartmented display box is erected in the foregoing manner, the articles to be contained therein such as, for example, packets 50 may be placed in the display box as indicated in FIGS. 5 and 8.

At this point, it is to be noted that the articles to be contained in the display box can also be glass bottles or jars. However, it is understood that such shipping of glass may require the use of additional separator panels or inserts in order to eliminate or reduce breakage which may result from the glass-to-glass contact. Regardless of the form of the contents shipped, whether packets or glass jars, the parcticular articles should be of a uniform height not in excess of that of the rear wall panel 13 of the display box shown in FIGS. 5 and 8.

Figure 4:
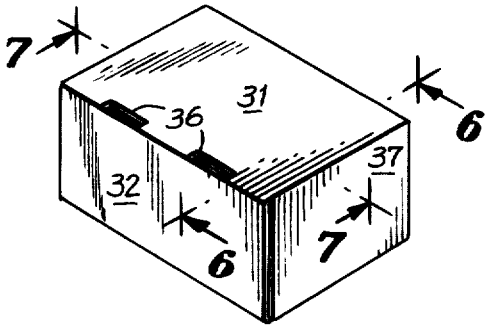
FIG. 4 is a perspective view of the fully erected and combination container and compartmented display box.

Once the compartments of the display box are completely filled, the combination shipping container and display box may be closed by folding the cover section forward along perforated lateral fold line 28, as shown in FIG. 5. A perspective view of the outside of the completely formed and filled combination shipping container and display box, with the cover section therefor in its closed position, is shown in FIG. 4 taken along lines 6–8 and 7—7.

After the filled combination shipping container and display box is received by the retail merchant, the contents therein may be displayed by separating the cover section from the display box by merely cutting along perforated score line 28 to produce the uncovered display box shown in FIG. 8. As previously indicated, if desired, divider wall 44 may also serve as a vertically extended display panel which can render the filled display box more attractive. This optional, alternate use of divider wall 44 is effected by removing it from its initial engagement with divider wall 45 and mounting it onto the latter by fitting slot 47 onto notch 49.

Thus, it becomes apparent that this invention provides a novel combination shipping container and display box which can readily be erected from a single-piece paperboard blank. The blank of the packaging unit embodied in this invention is of such relatively simple design and unique self-containing construction that the combination shipping container and display box formed therefrom can be erected without the aid of any extraneous means of securance such as staples, glue, straps, rivets, etc.

What is claimed is:

1. A combination shipping container and display box formed from a single-piece blank of corrugated board, comprising:

a. A compartmented display box portion defined by a substantially rectangular bottom panel having two opposed side walls, a front wall, and a rear wall, said side walls and said front wall being comprised of a plurality of layers of said corrugated board;

b. a separable cover section being defined by a substantially rectangular top panel having two opposed side walls, a cover section front wall, and a back wall including hinged connecting means for connection thereof and separation therefrom of said cover section from said rear wall of said display box portion, said side walls and said cover section front wall being comprised of a plurality of layers of said corrugated board, said cover section front wall overlapping said front wall of said display portion;

intersecting divider walls which form a plurality of compartments in said display box portion, said divider walls being integral with an obtained from said back wall of said cover section to which it is detachably connected in said single-piece blank of corrugated board; and d. hinged connecting means including a fold line sufficiently weakened to enable separation of said cover section from said display box portion.

2. A combination shipping container and display box as described in claim 1, wherein said front wall of said display box portion is comprised of a first intermediate panel hingedly connected by a fold line to one of said opposed side walls of said display box portion, a second intermediate panel hingedly connected by a fold line to the other of said opposed side walls of said display box portion, and an outer front wall panel which is hingedly connected by a fold line to said bottom panel and which overlies said first and second intermediate front wall panels.

3. A combination shipping container and display box as described in claim 1, wherein said front wall of said display box portion further includes an inner front wall panel hingedly connected by a fold line to said outer front wall panel and underlaying said first and second intermediate panels whereby said inner front wall panel forms the inner surface of said front wall of said display box portion.

4. A combination shipping container and display box as described in claim 3, wherein said side walls of said display box portion are each comprised of an intermediate side wall panel hingedly connected by a fold line to said rear wall, an outer side wall panel hingedly connected by a fold line to said bottom panel, and an inner side wall panel hingedly connected by a fold line to said outer side wall panel which underlies said intermediate side wall panel thereby forming the inner surface of said respective side walls.

5. The blank of claim 4 in which said intermediate side wall panels have dimensions essentially the same as, but not greater than, the corresponding inner and outer side wall panels.

6. The blank of claim 5 in which each of said intermediate front wall panels has a height no greater than the height of said inner and outer front wall panels and wherein the length of each of said intermediate front wall panels is not greater than one-half the length of said outer front wall panel.

7. A combination shipping container and display box formed from a single-piece blank of paperboard, comprising:

a. a compartmented display box portion;

b. detachable intersecting divider walls;

c. a separable cover section for said display box portion;

d. said display box portion being defined by a substantially rectangular bottom panel having two opposed side walls, a front wall, and a rear wall which are hingedly connected to said bottom panel by means of fold lines;

e. said separable cover section being defined by a substantially rectantular top panel having two opposed side walls and a back wall, which are hingedly connected thereto by means of fold lines, and a perforated lateral fold line by which it is hingedly connected to the edge of the rear wall panel of said display box portion opposite that edge which is hingedly connected to said bottom panel;

f. said front wall of the display box portion includes an outer front wall panel which is hingedly connected to said bottom panel, an inner front wall panel and an overlapping top ledge panel disposed between said outer front wall panel and said inner front wall panel, said front wall top ledge panel being disposed between said outer front wall panel and said inner front wall panel and defined by a first pair of narrowly spaced parallel fold lines by which said inner front wall panel and said outer front wall panel is hingedly connected along the edge opposite that which is hingedly connected to said bottom panel, respectively, are hingedly connected thereto;

g. said overlapping inner front panel of the display box is provided with a first pair of tabs disposed along its edge opposite that which is hingedly connected to said front wall top ledge panel and a means defined by slots disposed laterally along the fold line for hingedly connecting said outer front wall panel of said display box portion to said bottom panel and adapted to receive the tabs of said overlapping inner front wall panel of said display box portion;

h. each of said outer side walls of said display box portion has a substantially rectangular intermediate front wall panel hingedly connected thereto by means of a fold line which is extended in a direction perpendicular to that by which said outer side wall is hingedly connected to said bottom panel;

i. each of said side walls of the display box portion includes a substantially pentagonal outer side wall panel which is hingedly connected to said bottom panel, a substantially pentagonal inner side wall panel, and an overlapping side wall top ledge panel disposed between said outer side wall panel and said inner side wall panel, said top ledge panel being disposed between said outer side wall panel and said inner side wall panel and defined by a second pair of narrowly spaced parallel fold lines by which said inner side wall panel and said outer side wall panel along the edge opposite that which is hingedly connected to said bottom panel, respectively, are hingedly connected thereto;

j. each of said outer side walls of the cover section has an intermediate rear wall panel hingedly connected thereto by means of a fold line perpendicular to that by which the corresponding cover section side wall is hingedly connected to said top panel;

said back wall panel includes an outer back wall panel which is hingedly connected along the edge opposite that which is hingedly connected to said top panel to one side of a back wall top ledge panel which is defined by a fourth pair of narrowly spaced lateral parallel fold lines and an overlapping inner back wall panel hingedly connected to and extending from the side of said side wall top ledge panel opposite that to which said back wall is hingedly connected;

1. said overlapping inner back wall panel is provided with a pair of tabs disposed along its edge opposite that hingedly connected to said back wall top panel, two interlocking divider walls for said display box which are detachably connected to the side ends of said inner back wall panel by means of perforated lines, and a means defining slots disposed horizontally along the fold line from which said outer back wall panel extends from said top panel and adapted for receiving said tabs of said overlapping inner back wall panel; and m. means of including a sufficiently weakened fold line for hingedly connecting and separating said cover section from said display box portion.

* * * * *